US005193611A

United States Patent [19]

Hesselgreaves

[11] Patent Number: 5,193,611

[45] Date of Patent: Mar. 16, 1993

[54] HEAT EXCHANGERS

[75] Inventor: John E. Hesselgreaves, Lanark, Scotland

[73] Assignee: The Secretary of State for Trade and Industry in Her Britannic Majesty's Government of the United Kingdom of Great Britain and Northern Ireland, London, England

[21] Appl. No.: 773,932

[22] PCT Filed: May 2, 1990

[86] PCT No.: PCT/GB90/00675

§ 371 Date: Nov. 5, 1991

§ 102(e) Date: Nov. 5, 1991

[87] PCT Pub. No.: WO90/13784

PCT Pub. Date: Nov. 15, 1990

[30] Foreign Application Priority Data

May 4, 1989 [GB] United Kingdom ..... 8910241

[51] Int. Cl.[5] ..... F28F 3/08

[52] U.S. Cl. ..... 165/165; 165/166; 29/890.039

[58] Field of Search ..... 165/165, 166, 167, 170; 29/890.039

[56] References Cited

U.S. PATENT DOCUMENTS

| | | | |
|---|---|---|---|
| 2,571,631 | 10/1951 | Trumpler | 165/166 |
| 2,656,159 | 10/1953 | Holm et al. | 165/166 |
| 2,782,009 | 2/1957 | Rippingille | 165/166 |
| 3,102,532 | 9/1963 | Shoemaker | 165/133 |
| 3,258,832 | 7/1966 | Gerstung | 29/890.039 |
| 3,341,925 | 9/1967 | Gerstung | 29/890.039 |
| 3,345,735 | 10/1967 | Nicholls | 29/890.039 |
| 3,814,172 | 6/1974 | Shore | 165/166 |
| 4,016,928 | 4/1977 | Bartels et al. | 165/165 |
| 4,359,181 | 11/1982 | Chisholm | 165/907 |
| 4,368,779 | 1/1983 | Rojey et al. | 165/165 |
| 4,624,305 | 11/1986 | Rojey | 165/165 |
| 4,665,975 | 5/1987 | Johnston | 165/167 |
| 4,762,172 | 8/1988 | Grehier et al. | 165/165 |

FOREIGN PATENT DOCUMENTS

| | | | |
|---|---|---|---|
| A0164098 | 12/1985 | European Pat. Off. . | |
| 2333697 | 1/1975 | Fed. Rep. of Germany | 165/166 |
| A2753189 | 6/1978 | Fed. Rep. of Germany . | |
| A3339932 | 5/1985 | Fed. Rep. of Germany . | |
| 1161810 | 6/1985 | U.S.S.R. | 165/166 |
| A857707 | 1/1961 | United Kingdom . | |
| A1197449 | 7/1970 | United Kingdom . | |

*Primary Examiner*—John Rivell
*Assistant Examiner*—L. R. Leo
*Attorney, Agent, or Firm*—Nixon & Vanderhye

[57] ABSTRACT

A heat exchanger including a plurality of fluid pathways (13, 15, 16, 17, 18) in which at least some are defined between surfaces of unperforated primary plates (10). Between the primary plates (10) are at least two secondary perforated plates (12) extending along the fluid pathway (13, 15, 16, 17, 18) with perforations (11) in adjacent plates (12) being staggered. Adjacent secondary (12) and primary (10) sheets are in contact such that conducting pathways (19) are formed extending between the two primary surfaces while areas of secondary plates (12) not in contact with other secondary plates (12) constitute secondary surfaces (22).

9 Claims, 8 Drawing Sheets

HEAT EXCHANGERS

BACKGROUND OF THE INVENTION

Field of the Invention

The present invention relates to heat exchangers of the type used for transmitting heat from one fluid flow to another. The fluid flows may be both liquid or both gaseous, one liquid and the other gaseous, or one or both flows might be a mixture of liquid and gas.

Heat exchangers are of considerable importance in many manufacturing processes and in many manufactured goods. A continual problem with the design of heat exchangers is the compromise between efficiency and robustness. Efficiency is, in general, improved by using thinner primary plates made up into tubes or ducts of small cross-section (a primary plate being a plate directly separating two different fluid streams). However this often leads to fragility. Undue fragility is unacceptable for many uses of heat exchangers—for example in motor vehicles. It is therefore common practice to use secondary plates in heat exchangers to improve the heat exchangeability, the strength or both.

A typical form of secondary plate consists of a series of fins extending into or through one fluid flow stream and bonded to one or more primary plates dividing that fluid flow stream from one or more flow streams of the other fluid. One example of a finned arrangement is described in U.S. Pat. No. 2,471,582 where one fluid passes through a tube which has applied to its outer surface at least one heat transfer fin formed from the material known as expanded metal. Expanded metal is a well-known engineering material and consists of a mesh produced by forming a plurality of slits in a metal plate and expanding the plate. This type of heat exchanger is of necessity fairly bulky. Also the means whereby the fins are bonded to the primary surface, such as brazing, can limit the materials available and can give rise to corrosion problems. Flow streams can be in crossflow or in counterflow, and in the latter case special distributor sections can be required to achieve uniform flow.

A more recent invention, offering greater compactness and range of construction materials, is the Printed Circuit Heat Exchanger or PCHE, (U.S. Pat. No. 4,665,975), in which flat plates are photochemically etched with heat-transfer passages and then diffusion bonded together to form a solid block. This can operate at very high temperatures and pressures. As with the plate-fin heat exchanger, the flow streams can be in either cross or counterflow. The plates in this heat exchanger, however, are all primary, leading to an inefficient use of material for many purposes such as gas flows.

The use of secondary plates raises its own problems, as it inevitably results in greater complexity, and extra volume. The extra volume is undesirable, as space is usually a major factor in industrial conditions. There is therefore a need for heat exchangers having secondary plates providing improved heat transfer properties and increased strength without an inordinate increase in size.

SUMMARY OF THE INVENTION

According to the present invention a heat exchanger includes a fluid pathway defined by primary surfaces in the form of surfaces of two parallel unperforated primary plates having between the primary surfaces at least two perforated secondary plates extending along the fluid pathway, characterised in that each secondary plate is flat and has unperforated edges and in that the secondary plates are stacked with perforations in adjacent plates staggered, adjacent secondary and primary sheets being in contact such that conducting pathways are formed extending between the two primary surfaces whilst areas of secondary plates not in contact with other secondary plates constitute secondary surfaces, the unperforated edges of the secondary sheets combining to form sealing strips.

In one form of the invention a heat exchanger is formed from a plurality of pathways stacked together with first and second fluids whose heats it is desired to exchange flowing in alternate pathways either in crossflow or in counterflow. In such arrangements, except in outermost pathways, each primary plate will preferably provide a primary surface for each of two adjacent pathways.

The use of perforated secondary plates positioned between two primary plates is well known. For example in GB-A-1450460 where a plurality of wire mesh screens are fitted normal to the fluid flow in a duct, and GB-A-1359659 where two parallel heat exchanger fluid channels are formed by a stack of elements each having two channel sections, each section having channels formed between a series of slats. The channels are staggered in adjacent elements so that a tortuous fluid path is formed. In both the prior art documents the fluid flow is normal to the secondary plates giving rise to considerable resistance to flow with a resultant high pressure drop.

In EP-A-0164098 a heat exchanger is described in which a plurality of secondary sheets formed from expanded metal (or, alternatively, or in combination with, tabbed sheets with tabs preferably punched out on three sides and bent obliquely outwards) are stacked between primary sheets. The disposition of these secondary sheets relative to one another (that is whether they are disposed with perforations overlying or otherwise) is not clear. However the intention appears to be that the angled webs of the expanded metal (formed by the expansion process), or the tabs, will direct the flow towards the primary plates and so improve heat transfer. This arrangement will inevitably produce high parasitic drag with its resultant increase in pressure drop in fluid passing between the plates. By contrast the secondary plates of the present invention lie parallel with the overall direction of flow. Deviation in this overall direction of flow to allow the fluid to pass between the staggered perforations results in the formation of highly three-dimensional and strong local streamwise vortices. These vortices thin the boundary layer giving very high transfer rates. The vorticity also prevents thick wakes from being formed downstream of each surface element, resulting in a comparatively low pressure drop.

The perforations in the secondary plates of the present invention are preferably set at an angle to the fluid pathway. The resultant heat exchanger is considerably smaller than conventional heat exchangers having a comparable performance.

The perforated plates may be formed from expanded metal, or may be perforated by punching, etching or other means.

BRIEF DESCRIPTION OF THE DRAWINGS

Some embodiments of the invention will now be described, by way of example only, with reference to the accompanying diagrammatic drawings, or which.

DETAILED DISCUSSION OF PREFERRED EMBODIMENTS

Figure 1:
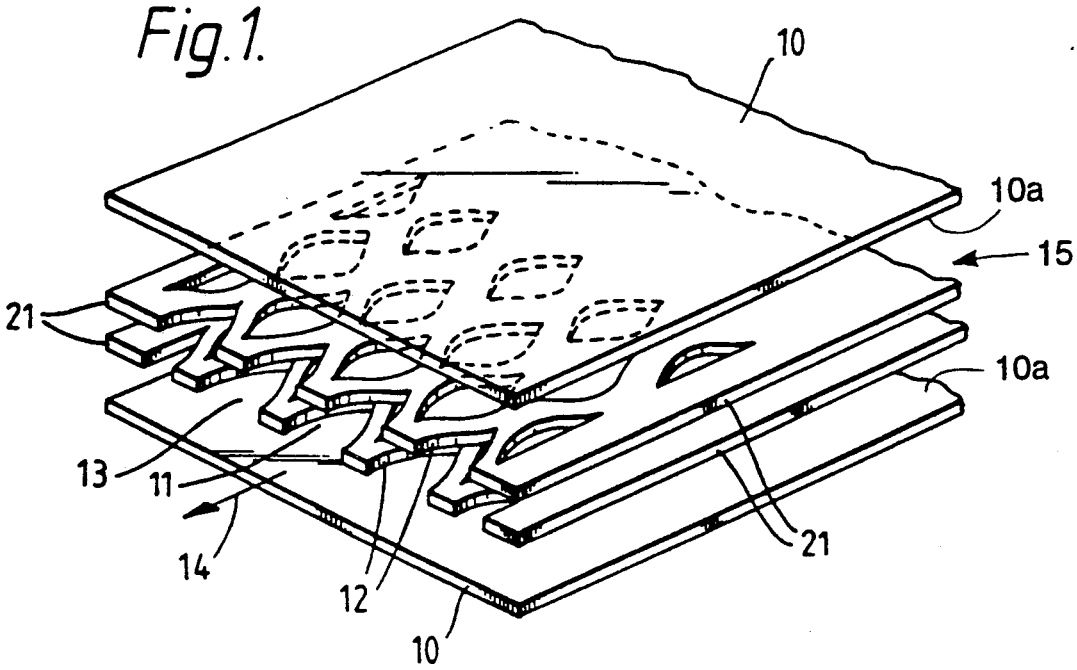
FIG. 1 is a perspective exploded view, in section, of part of a fluid flow channel of a heat exchanger according to the invention.

A fluid flow channel for use in a heat exchanger according to the invention (FIG. 1) has two unperforated primary plates 10 having primary surfaces 10*a* between which is defined a fluid pathway 15. Between the primary plates 10 are two or more perforated (with perforations 11) secondary plates 12, having unperforated edges 21, which are symmetrically and identically perforated and stacked with perforations 11 staggered (see also FIGS. 2, 2*a*, 2*b* and 2*c*) and overlying such that, other than at longitudinal edges 21 and lateral edges (not shown in FIG. 1) each perforation overlies two laterally and two longitudinally adjacent perforations in an adjacent secondary plate 12. The construction is such that plates 10 and 12 are in close contact, as illustrated in FIGS. 2*a*, 2*b*, 2*c* and the contact may enhanced by, for example, soldering or diffusion bonding at contact points to form conducting pathways 19 (FIG. 2*a*) between the two primary plates 10. Unperforated edges 21 are sealed together to prevent fluid passage. Areas of secondary plates 12 not in contact with other secondary plates 12 constitute secondary surfaces 22 (FIG. 2*b*).

For arrangement into a heat exchanger 77 (FIG. 1*a*) secondary pates 12 are formed with two sets of ports 73, 74 therein at lateral edges 70 (FIGS. 10*a*, 10*b*) the ports 73 being separated from the perforations 71 and the ports 74 connecting with the perforations 71. Primary plates 10 also have ports 73, 74 therein. A series of primary 10 and secondary 12 plates are stacked as shown in exploded perspective view in FIG. 1*a* such that secondary plates 12 between adjacent primary plates 10 have either ports 73 or ports 74 connecting with the perforations 11 whilst secondary plates 12 the other side of a shared plate 10 will have the other set of ports 73, 74 connected. At one end of the heat exchanger 77 is a sealing plate 76. Therefore, by connecting nozzles to the appropriate ports at the end of primary plates 10 two fluids can be passed through adjacent heat exchanger segments.

Figure 1A:
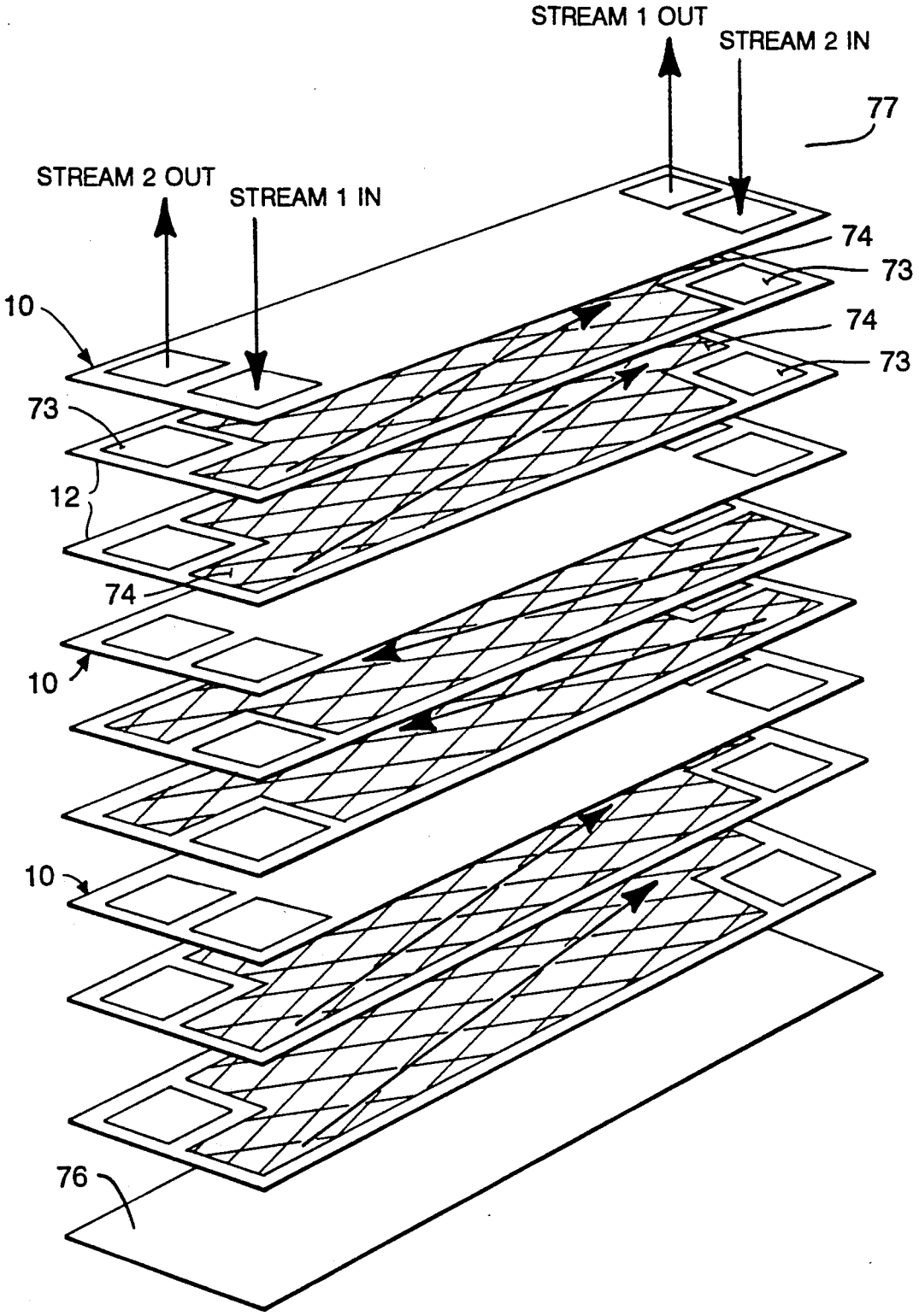
FIG. 1*a* is a perspective exploded view of a series of fluid flow channels, with inlet ports, combined to form a heat exchanger.

In use a flow channel such as that illustrated in FIG. 1 will form part of a heat exchanger with one fluid flowing through a flow path way 13 defined between the primary plates 10 and edges 21 as illustrated by the arrow 14, and a second fluid flowing external to the plates 10. There will be a plurality of fluid flow paths through the fluid pathway 13 as illustrated at 15, 16, 17 and 18 in FIGS. 3, 3*a*, 3*b*, 3*c* and 3*d*.

Figure 2:
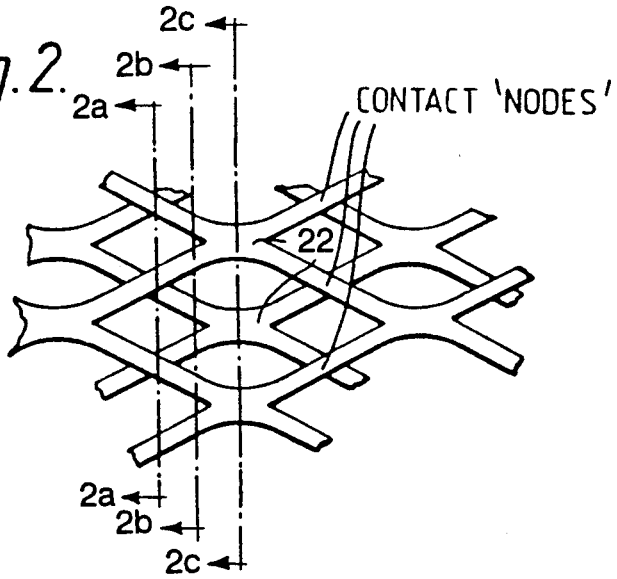
FIG. 2 is a plan view of part of the secondary plating of the fluid flow channel illustrated in FIG. 1.
Figure 2A:
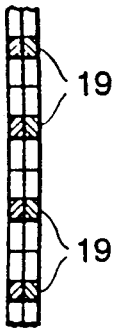
FIG. 2*a*, 2*b* and 2*c* are sectional views at AA, BB and CC respectively of FIG. 2.
Figure 2B:
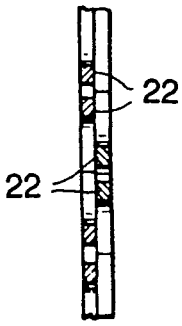
Figure 2C:
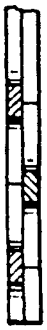
Figure 3:
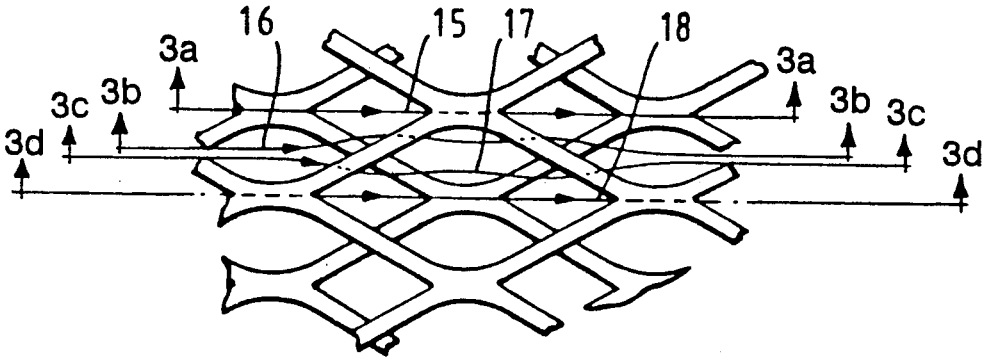
FIG. 3 is a plan view corresponding to FIG. 2, and FIG. 3*a*, 3*b*, 3*c* and 3*d* are sections along lines 11, 22, 33 and 44 of FIG. 3 illustrating 4 fluid flow paths through the secondary plates.
Figure 3A:
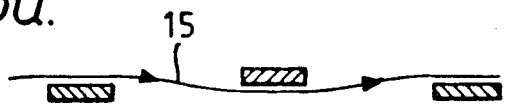
Figure 3B:
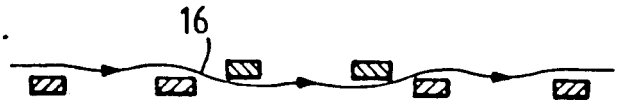
Figure 3C:
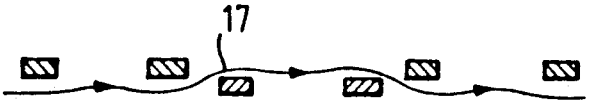
Figure 3D:
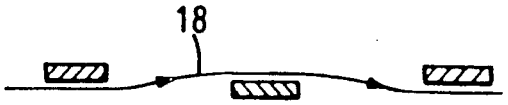

As illustrated in FIGS. 1 to 3 the secondary plates 12 are formed from flattened expanded metal.

Figure 4A:
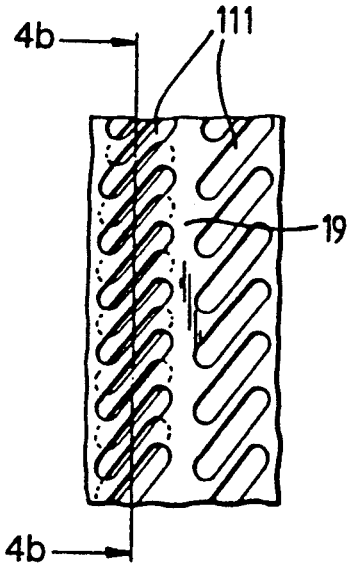
FIG. 4*a* is a plan view of an alternative form of secondary plating.
Figure 4B:
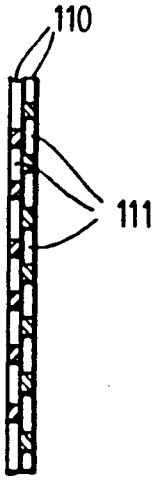
FIG. 4*b* is an elevation in section along line FF of FIG. 4*a*, FIG. 5*a*, is a plan view of yet another form of secondary plating.
Figure 5A:
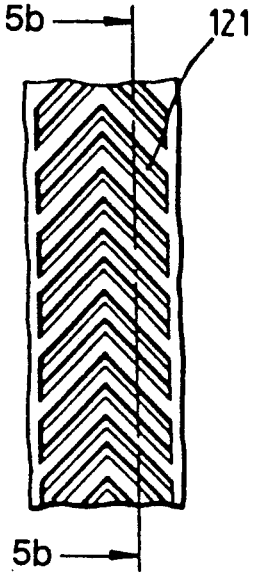
FIG. 5*b* is an elevation along line GG of FIG. 5*a*.
Figure 5B:
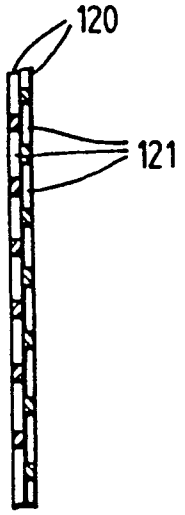
Figure 6A:
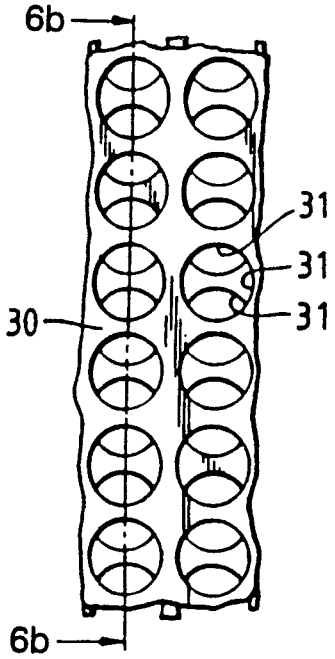
FIG. 6*a* is a plan of another form of secondary plating.
Figure 6B:
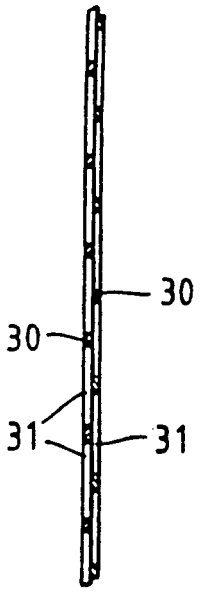
FIG. 6*b* is an elevation along line DD of FIG. 6*a*.

In another form of the invention (FIGS. 4*a*, 4*b*) secondary plates 110 have diagonal holes 111 formed therein, whilst in yet another form (FIGS. 5*a*, 5*b*) secondary plates 120 have chevron shaped holes 121 formed therein. In an alternative form (FIGS. 6*a*, 6*b*) secondary plates 20 have a plurality of circular holes 31 formed therein.

In all the above embodiments of the invention the perforations 11, 31, 111, 121 are at an angle to the flow (apart from the streamwise diagonal extremities of the circular holes 31). This results in the formation of highly three-dimensional and strong local streamwise vortices which thin the boundary layer so giving very high heat transfer rates. The vorticity also prevents thick wakes from being formed downstream of each surface element.

Figure 7A:
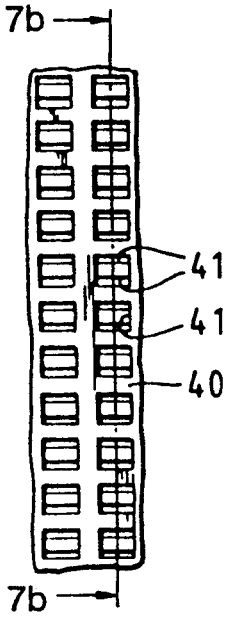
FIG. 7*a* is a plan view of another form of secondary plating.
Figure 7B:
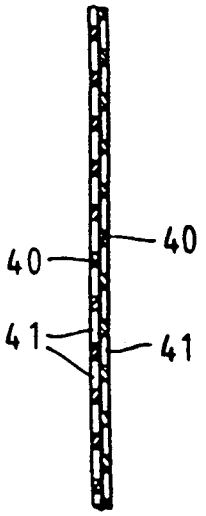
FIG. 7*b* is an elevation along line ER of FIG. 7*a*.

Yet another form of secondary plates 40 (FIGS. 7*a*, 7*b*) have perforations in the form of square or rectangular holes 41 formed therein. In this form of the invention the perforations 41 lie along the flow.

Figure 8:
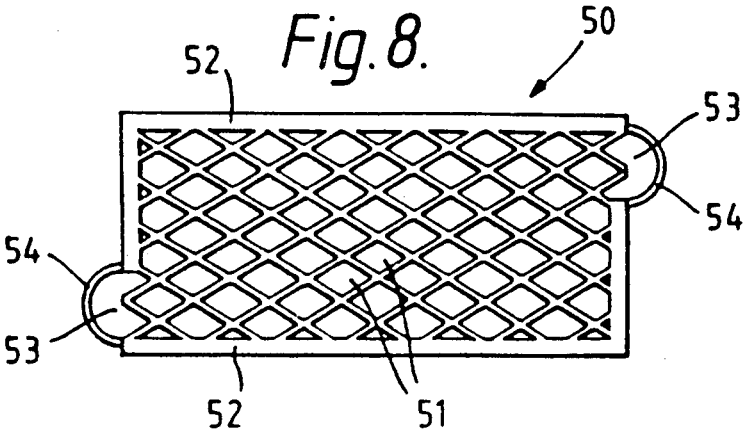
FIG. 8 is a plan view of a secondary plate for use with the invention.

One form of secondary plate 50 (FIG. 8) has perforations 51 formed therein and an unperforated edge strip 52 extending around its perimeter apart from at lengths 53 adjacent corners of the plate. A plurality of secondary plates 50 are stacked together between unperforated primary plates (not shown) and headers 54 secured by, for example, bonding to the unedged lengths 53 to allow for ingress and egress of fluid.

Figure 9B:
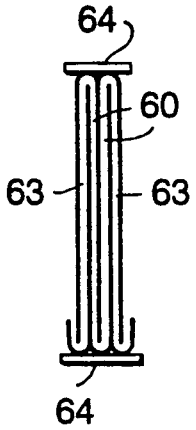
FIG. 9*b* is an end view of part of a heat exchanger formed from the secondary plate of FIG. 9*a*.
Figure 9A:
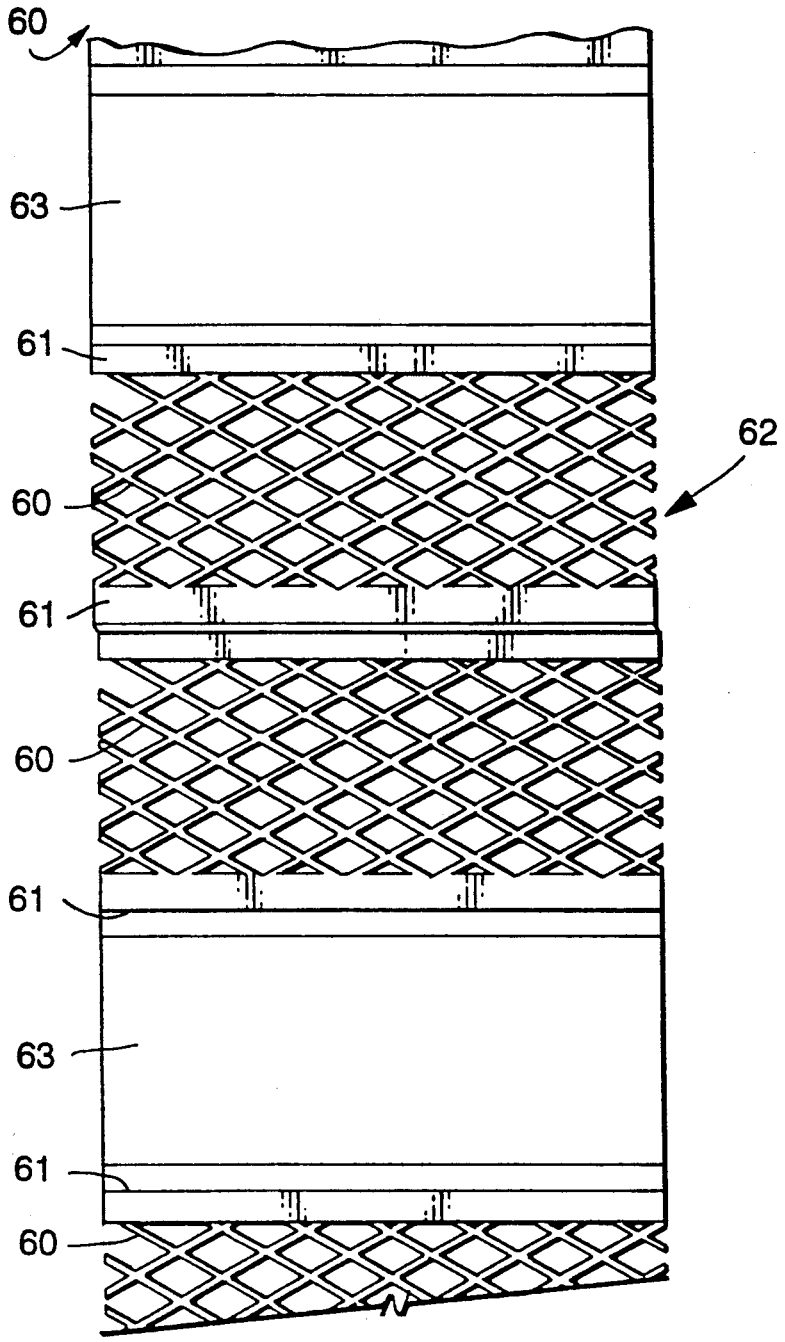
FIG. 9*a* is a plan view of another form of secondary plate for use with the invention.

In another form of the invention (FIG. 9*a*) a continuous sheet of material 62 has a number of equally sized perforated plates 60 formed therein as shown in the central portion of FIG. 9*a*, the secondary plates 60 being separated by unperforated portions 61. The sheet 62 is then folded along the centre sections of the strips 61 until the perforated portions 60 lie in contact (see FIG. 9*b*). It should be noted that for this form of construction adjacent perforated plates 60 should have their perforations out of synchronisation.

In a modification of this embodiment a number of perforated plates such as those shown at 60 are formed adjacent to one another, separated by unperforated portions such as 61, with regularly spaced unperforated plates 63. When this sheet is folded adjacent unperforated plates have their edges joined together as shown at 64 to define fluid pathways.

In yet another form of plate for use with the invention (FIGS. 10*a*, 10*b*) secondary plates 70 are formed with perforations 71 and sealing strips 72 and are formed with two sets of ports 73, 74 therein, the ports 73 being separated from the perforations 71 and the ports 74 connecting with the perforations 71. Primary plates 75 also have ports 73, 74 therein. A series of primary 75 and secondary 70 plates are stacked in order and bonded together such that secondary plates 70 between adjacent primary plates 75 have either ports 73 or 74 connecting with the perforations 71 whilst secondary plates 70 sharing a plate 75 will have the other set of ports 73, 74 connected. Therefore by connecting nozzles to the appropriate ports at the end of primary plates 75 two fluids can be passed through adjacent heat exchanger segments.

Figure 10A:
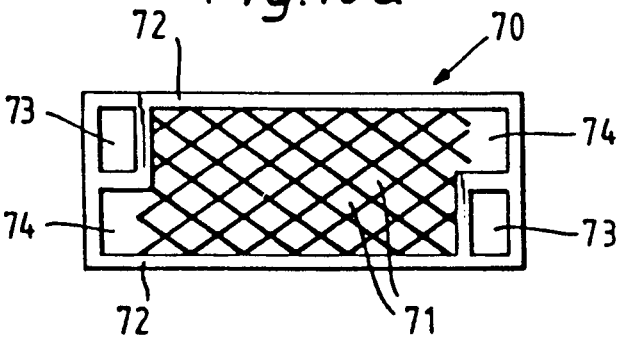
FIGS. 10*a*, 10*b* are plan views of secondary and primary plates respectively for use with an embodiment of the invention.
Figure 10B:
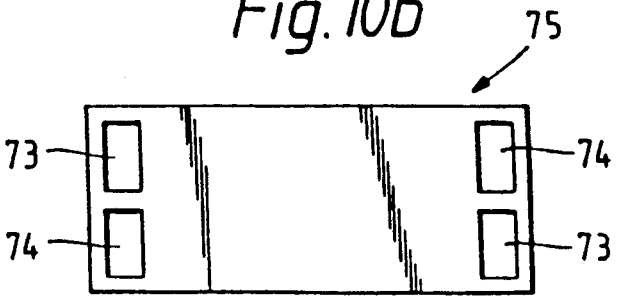
Figure 11A:
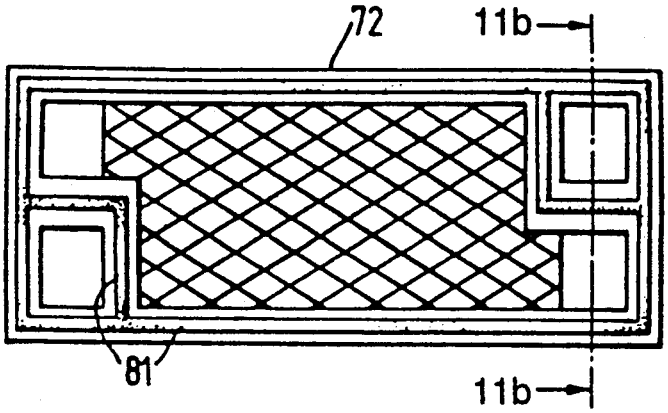
FIG. 11*a* is a plan view of a development of the secondary plate of FIG. 10*a*.
Figure 11B:
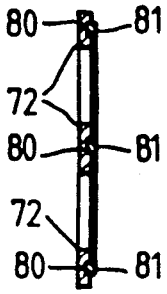
FIG. 11*b* is an elevation in section along line FF of FIG. 10*a*.

In a modification of the type of plate described with reference to FIGS. 10*a* and 10*b* (FIGS. 11*a*, and 11*b*) a channel 80 in the edge sections 72 holds a sealing strip 81. Heat exchangers formed form plates such as this (and corresponding primary plates 75) are formed by clamping plates together. With designs of this type of segment care must be taken that the perforated parts of the plates are in thermal contact. This type of construction enables plates to be easily removed for, for example, cleaning or replacement.

Figure 12:
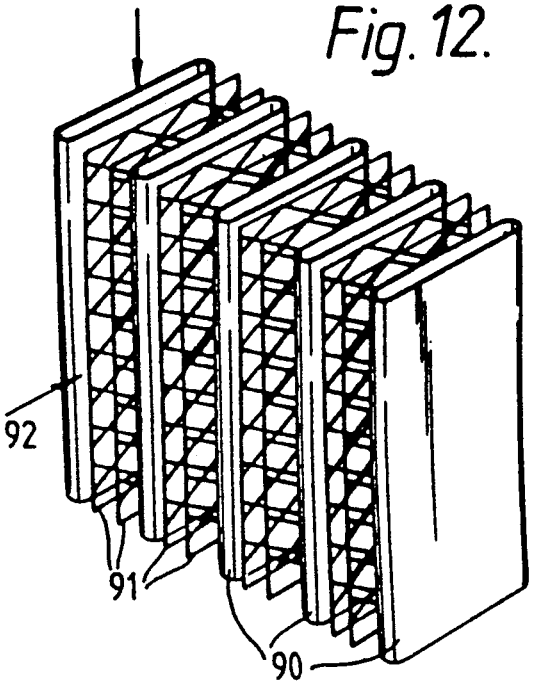
FIG. 12 is a perspective view in section of part of a heat exchanger according to the invention.

In a typical heat exchanger according to the invention (FIG. 12) suitable, for example, as an automobile radiator, liquid flow tubes 90 are alternated with multiplate layered perforated sections 91 as described above.

A cooling (or heating) gas flow is made to pass through these multilayered sections at right angles to the liquid flow, as illustrated at 92.

It will be appreciated that many alternative methods of using the inventions are possible.

What is claimed is:

1. A heat exchanger including a series of fluid pathways, said heat exchanger comprising:

a plurality of primary surfaces, each fluid pathway being defined by primary surfaces in the form of surfaces of two parallel unperforated primary plates;

at least two secondary plates extending along the fluid pathway between each two primary plates, each secondary plate being flat and being unperforated edges, each secondary plate having their a plurality of perforations, the perforations in adjacent secondary plates being staggered but overlying such that each perforation, other than at edges of the secondary plates, overlies two laterally and two longitudinally adjacent perforations in an adjacent secondary plate;

means for securing the primary plates to the secondary plates and for securing the secondary plates together at positions where the secondary plates contact one another to form heat conducting pathways between the two primary surfaces, area of secondary plates not in contact with plates constituting secondary surfaces, said unperforated edges of the secondary sheets combining to form sealing strips;

the series of fluid pathways being stacked together such that adjacent fluid pathways have a common primary plate;

inlet and outlet means connected to said fluid pathways, whereby first and second fluids are supplied to the heat exchanger such that the first and second fluids flow through adjacent fluid pathways.

2. A heat exchanger as claimed in claim 1 wherein said two fluid flows separated by unperforated plates are parallel to one another.

3. A heat exchanger as claimed in claim 1 wherein said two fluid flows separated by unperforated plates are normal to one another.

4. A heat exchanger as claimed in claim 1 wherein the perforated plates are formed from flattened expanded metal.

5. A heat exchanger as claimed in claim 1 wherein said the perforated plates are formed by punching.

6. A heat exchanger as claimed in claim 1 wherein said perforated plates are formed by etching.

7. A heat exchanger as claimed in claim 1 wherein said perforated plates are formed in a continuous sheet with separating unperforated portions along which the sheet is folded back on itself, perforations in adjacent plates (60) being staggered.

8. A heat exchanger as claimed in claim 1 wherein said perforated plates are formed in a continuous sheet with separating unperforated portions, the sheet also containing regularly spaced unperforated plates, such that when the sheet is folded back on itself along the unperforated portions adjacent unperforated plates can have their edges joined together to define fluid pathways.

9. A heat exchanger as claimed in claim 1 wherein said perforations are set at an angle to the fluid pathway.

* * * * *